US005689573A

United States Patent [19]

Jones

[11] Patent Number: 5,689,573

[45] Date of Patent: Nov. 18, 1997

[54] FREQUENCY-DEPENDENT AMPLITUDE MODIFICATION DEVICES FOR ACOUSTIC SOURCES

[75] Inventor: P.K.G. Jones, Londonderry, N.H.

[73] Assignee: Boston Acoustics, Inc., Lynnfield, Mass.

[21] Appl. No.: 817,524

[22] Filed: Jan. 7, 1992

[51] Int. Cl.[6] ..... H04R 75/00

[52] U.S. Cl. ..... 381/154; 381/153; 381/159

[58] Field of Search ..... 381/154, 159, 381/153; 181/182, 183, 186, 187, 148, 146, 175; 84/410, 202, 194, 204

[56] References Cited

U.S. PATENT DOCUMENTS

| | | | |
|---|---|---|---|
| 1,969,704 | 8/1934 | D'Alton | 181/148 |
| 2,234,833 | 3/1941 | Preston | 381/202 |
| 3,467,218 | 9/1969 | Fujimoto et al. . | |
| 3,684,051 | 8/1972 | Hopkins | 181/31 B |
| 4,142,603 | 3/1979 | Johnson | 181/148 |
| 4,190,746 | 2/1980 | Hardwood et al. | 381/204 |
| 4,284,166 | 8/1981 | Gale | 181/156 |
| 4,322,578 | 3/1982 | Selmin | 179/1 E |
| 4,421,957 | 12/1983 | Wallace, Jr. | 181/182 |
| 4,800,983 | 1/1989 | Geren | 181/155 |
| 4,836,326 | 6/1989 | Wehner | 181/144 |
| 4,869,340 | 9/1989 | Coudoux | 181/146 |
| 4,903,300 | 2/1990 | Polk | 381/24 |
| 4,924,963 | 5/1990 | Polk | 181/144 |
| 5,010,977 | 4/1991 | Furukawa et al. . | |

FOREIGN PATENT DOCUMENTS

| | | |
|---|---|---|
| 0 275 195 | 7/1988 | European Pat. Off. . |
| 2359474 | 2/1978 | France . |

*Primary Examiner*—Sinh Tran
*Attorney, Agent, or Firm*—Lappin & Kusmer LLP

[57] ABSTRACT

Apparatus for and method of correcting multiple distortions in the form of amplitude variations in and extending the output response of acoustic devices are disclosed. In one embodiment, a set of one or more hollow pipes or conduits of predetermined sizes is positioned adjacent to an acoustical source and oriented such that the axis of each pipe is at an angle to the axis of the sound and at least one open end of each of the pipes intercepts the sound as it is propagated. In an alternative embodiment, comparable results are achieved by positioning a slotted bridge, with one or more elongated slots of predetermined size, adjacent to an acoustical source such that the axis of each slot is oriented substantially perpendicular to the axis of the sound and the sound wave intercepts the open edge of each of the slots.

19 Claims, 3 Drawing Sheets

FREQUENCY-DEPENDENT AMPLITUDE MODIFICATION DEVICES FOR ACOUSTIC SOURCES

The present invention relates generally to acoustic sources, and more particularly, to frequency-dependent amplitude modification devices for such acoustic sources.

BACKGROUND OF THE INVENTION

The present invention is particularly helpful in improving the performance of loudspeaker systems and similar acoustic devices, where acoustic signals are produced with one or more loudspeaker drivers. A loudspeaker driver is a transducer for converting variations of electric energy into corresponding variations of acoustic energy, i.e. sound. In general, one type of loudspeaker driver, referred to as a moving coil driver, includes an electromagnetically-operated voice coil connected to a cone or diaphragm supported by a suspension system. Other types of drivers include ribbons and electrostatics, where some sort of diaphragm is moved by way of a magnetic, electrostatic or other force. But, loudspeaker systems typically exhibit a number of problematic frequency response variations. Some of the reasons for these variations include: break-up resonances of the loudspeaker drivers' diaphragms, crossover saturation distortion, port colorations and acoustic feedback.

For example, loudspeaker drivers, such as woofers, midranges and tweeters, each typically has a substantially constant amplitude acoustic output response within a predetermined frequency band up to a certain frequency (the "roll-off" frequency), above which the acoustic output falls off with an increase in frequency (called "roll-off"). Around or above the roll-off frequency there often occur sharp spikes or peaks (amplitude or variations anomalies) stemming from the resonances (break-up modes) of the driver's diaphragm material. While these resonant peaks are hardly noticeable for some common diaphragm materials, such as some forms of polypropylene and paper, these non-rigid materials exhibit a mechanical hysteresis phenomenon (i.e., a "lossy" character) and thus poorly reproduce fine detail of the original program signal. Diaphragms made of metal, such as titanium or aluminum, on the other hand provide improved tracking of the input signal, but also large resonant peaks near the natural roll-off frequency of the speaker, with the higher frequency speakers producing more resonant peaks than the lower frequency speakers. These variations are related to diaphragm size, mass, voice coil diameter, and modulus of elasticity/mass ratio of the cone material. Specifically, the resonances are due to the high sonic velocity of the material itself, and a relatively high modulus of elasticity to mass ratio causes the material to have strong resonant modes at typically higher frequencies than polypropylene or paper. These resonances are of a high Q, i.e., producing amplitude peaks which are quite sharp, due to the natural absence of self damping by the material itself.

Additionally, certain loudspeaker systems can exhibit problems relating to speaker port coloration, while amplification systems can create acoustic feedback. Speaker ports (sometimes called vents) typically are used in conjunction with large speaker drivers, called "woofers", for producing low frequency sound, wherein the air mass within the cabinet resonates to produce low frequency sound through the speaker's port(s). The speaker port coloration problem is caused by the fact that the air column in a vented speaker system's port will resonate in response to the speaker system's output. When the port length is an odd multiple of a half wavelength of a given frequency, then the port will resonate at that frequency. This can cause undesirable colorations (amplitude variations) at these frequencies. Also, standing waves can build up within the enclosure when acoustic energy is present at frequencies having wavelengths matching the enclosure's internal dimensions. Corresponding port and enclosure resonances will reinforce each other, exacerbating the problem. Finally, acoustic feedback results when an amplified public address system oscillates due to positive feedback between a microphone and a speaker. While such problems can be corrected through judicious microphone and speaker placement, such physical solutions are not always options.

Normally, when material break-up modes, port coloration, crossover saturation or feedback are deemed to be threats to the sound quality, electronic networks with steep crossover network slopes or equalizers are used to reduce the audible output where problems occur. Both crossover networks and equalizers are used to filter the electrical signal used to drive each loudspeaker system so as to prevent each loudspeaker from producing acoustic signals at the offending frequencies. Passive and active electronic networks are often inefficient, cumbersome and expensive. Other problems with or limitations of conventional loudspeaker systems are created by the use of networks. Passive crossover networks, for example, create distortions stemming from their components—particularly the inductors. Inductors with iron cores distort signals because of the hysteresis character of the ferrous core material, and when the signal amplitude is large the inductor can reach a point of current saturation. An inductor is almost always connected in series with a driver with a troublesome upper band in order to provide a smoother roll-off. This inductor affects the system's impedance, and in turn the amplifier's control over the system, even down into the pass band of the driver. Sound reinforcement engineers use third-octave equalizers to tune out offending frequencies resulting from positive feedback between a microphone and loudspeaker system, but simultaneously remove a portion of the program, because the Q and frequency precision of the available bands is not great enough.

On the other hand, conventional loudspeaker drivers generally have natural operating bandwidths that cover only a portion (perhaps a half or third) of the audible sound band. It is considered desirable to extend any one driver's usable bandwidth, as this typically simplifies the entire speaker system. Thus, use of a crossover network or equalizer has tradeoffs.

In accordance with two embodiments of the present invention the output response characteristics of an acoustic loudspeaker driver are modified in order to easily correct for distortions in the form of amplitude variations of the frequency response of the driver by using specially designed pipes and/or slots so that greater use can be made of the natural operating bandwidth of the driver. A number of recent patents on improvements in acoustic speakers employ one or more tubes or conduits in proximity to the diaphragm of a speaker driver. But, such constructions differ in important respects from the present invention and, in addition, do not achieve the correction of multiple frequency distortions in the form of amplitude variations simultaneously with the extension of output response as with the apparatus and method of the present invention.

For example, U.S. Pat. No. 4,142,603 (Johnson), relating to an adjustable speaker cabinet, shows tubes 56 positioned inside a loudspeaker enclosure as "wave guide tubes." U.S. Pat. No. 3,684,051 (Hopkins), relating to an acoustic duct speaker system, shows an acoustic duct means 18, comprising a bundle of parallel flutes, tubes or conduits, mounted in the front panel 12 of a bass reflex loudspeaker such that the axes of the tubes are parallel to the axis of the speaker. The objective of the Hopkins invention is to modify the effect of a traditional port, not to correct for spurious resonances that might occur as a result of the port or speaker drivers. U.S. Pat. No. 4,869,340 (Coudoux), relating to high performance loudspeaker enclosures, shows an enclosure whose walls are lined on the inside with contiguous parallel tubes 9 which are filled with sand, graphite or silica. These filled tubes are used only for structural strength and acoustic deadness. U.S. Pat. No. 4,836,326 (Wehner), relating to a shadow omniphonic microphone and loudspeaker system, describes the use of shielding cylinders, collectively designated 49, adjacent the front of the cones of the speakers 42A, 42B, 43A and 43B. In U.S. Pat. No. 4,322,578 (Selmin), relating to achieving omnidirectional radiation of sound waves, speakers direct sound to transversely mounted parallel reflectors. This invention does not involve the use of a resonating air mass nor of a resonating air column.

U.S. Pat. Nos. 4,903,300 (Polk I) and 4,924,963 (Polk II), relating to a loudspeaker system for installation in a wall or ceiling, show the use of a single, internal acoustic trap 27 (FIGS. 8–10) or a Helmholtz resonator 28 (FIG. 11). According to Polk, the acoustic trap 27 is provided "to eliminate the undesirable frequencies" and it consists of "a tube sealed at one end and opening into the side of the port at its other end, with its length being one-fourth of the wavelength of the lowest undesirable frequency," (Polk I, col. 7, lines 30–46). The acoustic trap and Helmholtz resonator of the Polk patents therefore is provided to correct for a frequency variation determined with respect to the internal design of the speaker system, and not necessarily based on how the acoustic output is heard by the listener. It is further noted that the Polk patents relate to acoustic waves produced by transducers 17 and 18 and do not suggest the utility of an acoustic trap or Helmholtz resonator in conjunction with a driver. In addition, a single trap or resonator internally mounted within the speaker system has limited effect on the frequency response of the system since the trap or resonator is designed to have an effect only on a relatively narrow band of output frequencies. Furthermore, because it is mounted internally inside the speaker system, there is no easy way to access or modify the acoustic trap of Polk to correct for different undesirable frequencies. Finally, these devices have no beneficial effect whatsoever in broadening the speaker's natural usable bandwidth.

These and other problems with and limitations of the prior art are overcome with the frequency-dependent amplitude correction and modification devices of this invention. More particularly, a device that can selectively trap multiple unwanted frequencies from a speaker's output may be used to ameliorate these problems. Such traps, with narrower bandwidth characteristics and greater accuracy than typical electronic crossover or equalization networks, can replace these more expensive and cumbersome electronic solutions.

OBJECTS OF THE INVENTION

Accordingly, it is a principal object of this invention to provide a method of and apparatus for substantially reducing or overcoming the above noted disadvantages of the prior art.

Another, more specific object of the present invention is to provide a method of and apparatus for simultaneously correcting distortions in the form of amplitude variations in the frequency response within a plurality of narrow frequency bands, and extending the output response of an acoustic loudspeaker.

And another object of this invention is to provide a method of and apparatus for readily modifying the output response characteristics of an acoustic loudspeaker driver in order to easily correct for distortions in the form of amplitude variations of the frequency response of the driver.

It is also an object of this invention to provide a relatively inexpensive alternative to complicated crossover networks or equalization systems in audio equipment.

Specifically, it is an object of this invention to provide an externally-mounted bridge device comprising a set of hollow pipes or conduits of such predetermined sizes and so positioned with respect to the speaker so as to substantially eliminate undesirable frequency dependent, amplitude variations in the acoustic output of the speaker.

Still a further object of this invention is to provide an externally-mounted bridge device comprising elongated slots of predetermined sizes and so positioned with respect to the speaker as to substantially eliminate undesirable distortions in the form of amplitude variations in the acoustic output of the speaker.

Other objects of the invention will in part be obvious and will in part appear hereinafter. The invention according comprises the processes involving the several steps and the relation and order of one or more of such steps with respect to each of the others, and the apparatus possessing the construction, combination of elements, and arrangement of parts exemplified in the following detailed disclosure, and the scope of the application of which will be indicated in the claims.

SUMMARY OF THE INVENTION

The present invention comprises a device for readily modifying the output response characteristics of an acoustic source in order to easily correct for distortions in the form of amplitude variations of the frequency response of the source. The device comprises means for defining a cavity having at least one open end, the cavity being dimensioned so as to define an air column within the cavity of a predetermined dimension. The means for defining the cavity is supported so that the air column extends perpendicular to the axis of propagation of the acoustic signal with the open end disposed sideways to and in the path of the acoustic signal so as to produce a resonance at a frequency within the frequency band opposite in phase to the amplitude variation.

In an embodiment of the apparatus of the present invention a plurality of hollow pipes or slots of predetermined size so as to define the air column (within the pipe or slot) as a function of the frequencies at which amplitude correction is provided. The numbers and sizes of the hollow pipes or slots are determined according to the number and wavelengths of the frequencies where variations, in the form of amplitude spikes or peaks, occur in the natural output of the acoustic device with which the pipes and slots are used. The apparatus is preferably externally mounted over or near the face of the acoustic device or else positioned adjacent to the speaker such that the elongated axes of the pipes or slots are substantially perpendicular to the axis of propagation of the acoustic signals produced by the acoustic device, and at least one open end of each hollow pipe, or each open edge of the slots, intercepts the acoustic signals from the acoustic device. Alternative embodiments are also described herein.

BRIEF DESCRIPTION OF THE DRAWINGS

For a fuller understanding of the nature and objects of the present invention, reference should be made to the following detailed description taken in connection with the accompanying drawings wherein.

DETAILED DESCRIPTION OF THE DRAWINGS

In accordance with the present invention a device is provided for correcting for frequency-dependent amplitude variations within at least one narrow frequency band generated in the acoustic output from an acoustic source. The device comprises means for defining a cavity having at least one open end, the cavity being dimensioned so as to define an air column within the cavity of a predetermined dimension. The cavity can be in the form of one or more hollow pipes having at least one open end, as shown and described in connection with FIGS. 1A, 1B, 2A, 2B, 3A, 3B and 4, or one or more slots as shown and described in connection with FIGS. 5A and 5B, or a combination of both. The device also includes means for supporting the means for defining the cavity at the acoustic signal output of the acoustic source so that the air column (defined by the internal dimensions of each pipe or slot) extends at an angle to the axis of propagation of the acoustic signal output of the acoustic source with the open end disposed in the path of the acoustic signal output so as to produce a resonance at least at one frequency within the frequency band opposite in phase to the amplitude variation so that said variation is substantially canceled.

Figure 1A:
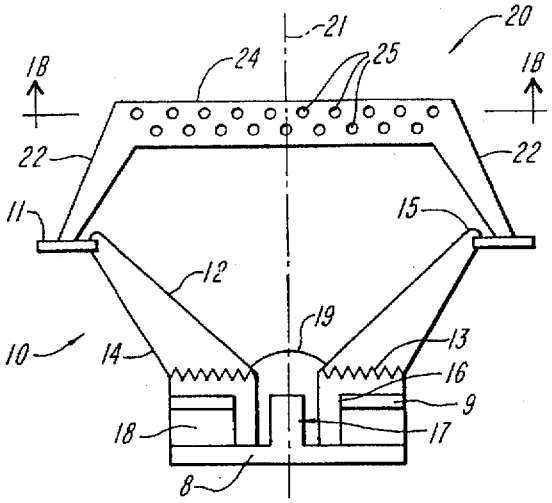
FIG. 1A is a schematic side plan view of a low frequency "woofer" loudspeaker driver including a pipe bridge in accordance with the present invention.

FIG. 1A is a schematic representation of a first embodiment of the present invention shown in use for correcting and therefore extending the usable output spectral response of a low frequency (e.g., 30 Hz–3 kHz), relatively large "woofer" speaker system 10. The speaker system comprises an toroidal shaped electro-magnet 18, supported between a back plate 8 and front plate 9. A pole 17 is supported on the backplate 8 and is disposed within the electro-magnet so that the coil and cone will move in response to the electromagnetic force created by the electro-magnet when a electrical drive signal is applied to the electro-magnet. System further includes a cone 12, cone basket 14, inner suspension 13, outer suspension 15, dust cap 19, and rim 11. To the extent described thus far, the speaker system of FIG. 1A and 1B is conventional.

Figure 3A:
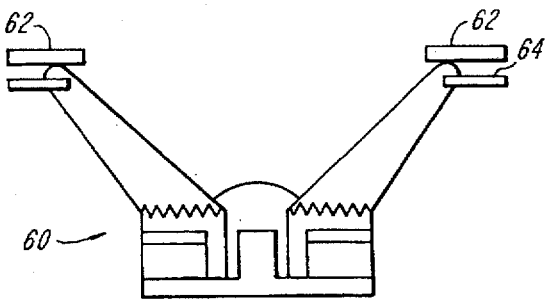
FIG. 3A is a schematic side plan view, in cross section, of a loudspeaker driver including a set of perimeter mounted pipes in accordance with the present invention.
Figure 3B:
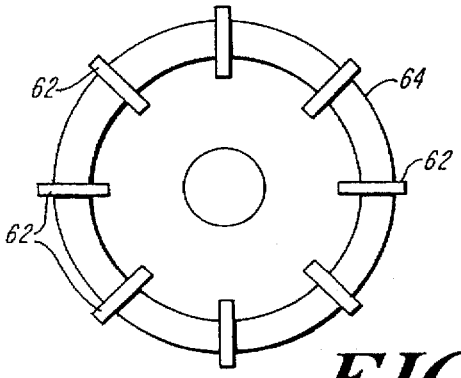
FIG. 3B is a schematic top view of the loudspeaker driver of FIG. 3A.
Figure 4:
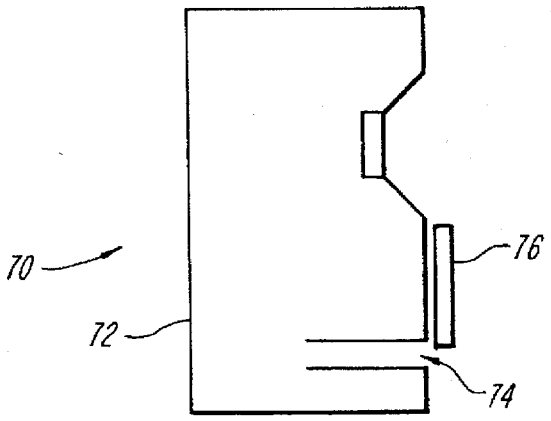
FIG. 4 is a schematic sectional side view of a loudspeaker system, including a ported enclosure, illustrating the mounting of a pipe in accordance with the present invention so as to ameliorate speaker port coloration distortion in the form of amplitude variations.

In accordance with one embodiment of the present invention, hollow pipes of predetermined dimensions and having at least one open end are supported so that the open end of the pipe intercepts the acoustic output of the loudspeaker system. In accordance with a second embodiment means for defining open ended slots of predetermined dimensions are similarly supported so that the open end of each slot intercepts the acoustic output of the loudspeaker system. The pipes and slots can be supported by a support structure separate from the speaker system, such as the bridge structures shown in FIGS. 1A, 1B, 2A, 2B, 5A and 5B, by the speaker cabinet, such as shown in FIG. 4, or by the speaker system, as shown in FIG. 3A and 3B, as will be described in greater detail hereinafter, or in any other manner which will be apparent to those skilled in the art.

Figure 1B:
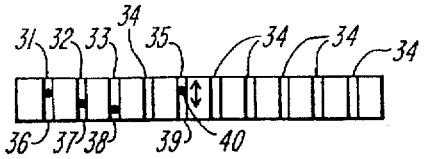
FIG. 1B is a top sectional view of the pipe bridge taken in cross section along the line 1—1 of FIG. 1A.

Referring to the embodiment in FIG. 1A and 1B, for example, a pipe bridge 20 is supported in the path of the acoustic signal output of the acoustic source so as to modify the amplitude of the acoustic signal output at one or more frequencies. Pipe bridge 20 can be fastened to rim 11 or other portions of the loudspeaker system, including the cabinet surrounding the speaker (not shown). The bridge 20 is supported by any suitable means, such as mounting screws or bonding adhesives. For some applications, ease of removing and changing pipe bridge 20 will be important; for other applications, a more permanent mounting may be more desirable.

Pipe bridge 20 supports one or more pipes 24 and 26 so that, as described in greater detail hereinafter, at least one open end of each pipe is disposed so as to intercept the acoustic signal output of the speaker system. As shown, for example, the bridge comprises two side arms 22, each disposed at an angle with respect to the plane of the speaker face (rim 11) so that the arms are connected at one end thereof to pipe support section 24 and at the other end thereof to rim 11 or other support means, as described above. While the pipe support section 24 is shown extending diametrically across and substantially parallel to the face of the speaker driver, it should be appreciated that it is within the scope of the present invention that the bridge can be positioned off-center with respect to the center speaker face.

Pipe section 24 of bridge 20 comprises one or more hollow pipes, tubes, or conduits, collectively identified in FIG. 1A by reference numeral 26, supported adjacent or in close proximity to the speaker face such that the elongated axis of each hollow pipe, tube or conduit extends at an angle (not parallel) to the axis of propagation of the sound waves of the acoustic signal output of the system 10 (indicated as axis 21 in FIG. 1A) so that at least one open end of the pipe, tube or conduit intercepts those sound waves. While the precise angle of the pipe relative to the axis of propagation is shown at 90°, it should be appreciated that the actual angle can vary, although as the pipe approaches a parallel position to the axis, it will lose its correcting effect.

In one embodiment, hollow pipes 26 are formed as holes through the pipe support section 24 and are open at opposite ends passing from the top face of pipe section 24 through to the bottom face as best seen in FIG. 1B. In another embodiment, the holes are provided with an opening at only one end such that the depth of each hole is less than the thickness of the pipe support section so that the holes do not pass completely through the section.

Thus, for example, as illustrated in FIG. 1B, a cross-sectional view of bridge 20 along the line 1—1 in FIG. 1A, some of the holes may pass completely through pipe support section 24, e.g. holes 34, whereas other holes are provided with only one open end in the top face, e.g. holes 36, 37, 38 and 39, or in the bottom face, e.g. holes 31, 32, 33 and 35. In still a further embodiment of this invention, a hole with two open ends may be fitted with a movable plug or plunger, which makes it possible to adjust the depth of the closed-end of the holes formed respectively in the top and bottom faces of pipe section 24 in order to fine tune the corrective abilities of this device, as will be more evident hereinafter. For example, in FIG. 1B, the solid separation section separating front hole 39 and rear hole 35, may be bored out and replaced with a movable plug 40 capable of sliding in conduit 35–39 as shown by the arrows.

The present invention is based on the principle that the signal energy of an acoustic signal at a particular frequency can be "trapped" or diminished in amplitude by placing in the path of the acoustic signal at least one open end of a hollow pipe, tube or conduit of suitable dimensions. If the pipe is open at both ends, and both open ends are oriented perpendicular to and disposed in the path of the acoustic signals, the pipe will "trap" a frequency $F_1$, having a wavelength $\lambda_1$, approximately equal to two times the length L of the pipe (i.e., $L \approx \frac{1}{2}\lambda_1$). The wavelength $\lambda$ of a particular frequency F is calculated by dividing the speed of sound (approximately 1130 feet per second in air) by the frequency. Alternatively, if one end of the pipe is closed and the one open end is in the path of the sound wave, the pipe will "trap" a frequency F having a wavelength $\lambda_2$ approximately equal to four times the length L of the pipe (i.e., $L \approx \frac{1}{4}\lambda_2$).

When a hollow tube or conduit has both opposite ends open, and both ends are placed in the path of the acoustic signal, the length of the tube is preferably approximately one-half of the wavelength of the component of the acoustic signal at the frequency at which amplitude correction is desired so that the air column in the tube will resonate in response to acoustic energy generated by the driver at the designed resonating frequency. Such a resonance occurs opposite in phase to the component of the original acoustic signal at the design frequency. The presence of such a resonance causes at least a partial cancellation, i.e., a drop in the amplitude of the component of the original acoustic signal at the design frequency. Tuning the length of the tube, or a combination of tubes, thus allows for precise spectral modification of the passing acoustic signal passing one or both ends of the tube. Alternatively, if one end of the tube is closed, the tube's length need only be approximately one-quarter the wavelength of the design frequency. Such a quarter wavelength tube, however, produces a smaller decrease in the amplitude of the original sound at the design frequency.

Multiple tubes may be used to amplify the correction effect. A plurality of identical tubes allow more drastic modifications of the passing acoustic signals at a particular frequency (higher Q and greater attenuation). On the other hand, multiple tubes of different lengths allow modifications at a variety of different frequencies (lower Q, and therefore less attenuation but over a larger frequency range). The diameter of a tube has no direct effect on the correction effect. Generally, however, the diameter of each tube preferably should be approximately between 10% and 50% of the tube's length. A smaller diameter tube will have frictional losses; a larger diameter tube will not allow the air to operate as an air column.

In a particular application, the required tube length may be predicted by taking the appropriate fractions of the chosen frequency's wavelength. Typically, tube length should be slightly smaller than predicted, owing to the impedance coupling between the air column and the outside air. Tube length may also be empirically determined by using a tube with a movable plunger. At each problem frequency a tone at the offending frequency can be played through the speaker, its acoustic output amplitude monitored with a sound pressure level measuring device. The plunger can be moved in the tube until a drop in the level of the acoustic amplitude is observed.

Figure 2A:
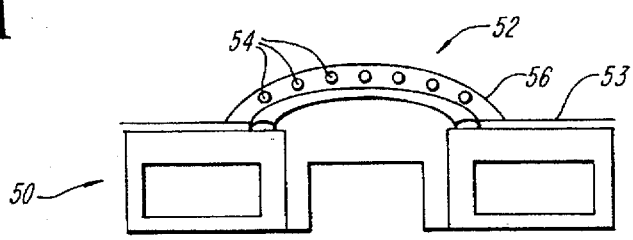
FIG. 2A is a schematic side plan view, in cross section, of a high frequency "tweeter" loudspeaker driver including a pipe bridge in accordance with the present invention.

FIG. 2A is a schematic representation of a second embodiment of the present invention especially suitable for correcting and extending the output response of a high frequency (e.g., 1 kHz–20 kHz), typically smaller "tweeter" speaker unit 50 comprising a standard dome diaphragm. Because high frequency speakers are typically smaller than low frequency speakers, the size of the bridge device and the acceptable lengths of frequency correction tubes becomes more critical. For this application, a modified form of a pipe bridge 52 comprising a plurality of hollow tubes 54 is preferably employed to achieve correction and extension of the speaker output response.

Pipe bridge 52 comprises a relatively narrow semicircular support band 56, the ends of which are supported, for example, on the outer facing edge of the speaker rim 53. As better seen in FIG. 2B, a schematic front view of the speaker system of FIG. 2A, the hollow tubes, collectively identified by reference numeral 54, are not integral with band 56 (as was the case with the holes 26 in pipe section 24 of FIGS. 1A and 1B) but rather comprise separate, independent tubes secured to band 56 by any suitable fastening means.

Figure 2B:
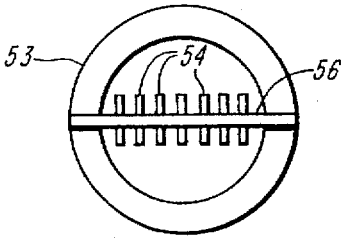
FIG. 2B is a schematic top view of the speaker system of FIG. 2A.

Similar to FIG. 1B, the internal length dimension and/or diameter of each of the hollow tubes 54 (i.e., the length and/or diameter of the air column in each of the tubes) in FIG. 2B can be the same, or different as required for appropriate frequency-dependent amplitude corrections. The internal length of each of the tubes may be variable by means of a movable plug or plunger positioned inside one or more of the tubes. In the case of smaller metal cone tweeters, as will be more evident hereinafter, correction is desired at several frequencies, so that multiple tubes of different lengths are used in such an application.

In all of the cases described above and below, the bridge results in a secondary beneficial effect of extending the usable frequency bandwidth of the sound source. This secondary effect is based on the principle that a speaker diaphragm's output response is modified by placing a constricting object in front of the diaphragm. By restricting the driver's output, the constricting object increases the output level in the upper range of the driver.

By building tubes of appropriate dimensions and orientations into such a constricting device, for instance, in the form of a bridge across a driver's face, it becomes possible to more carefully tailor the driver's response, having available means to both increase and decrease the level at different frequencies.

Typically, when used with a low frequency unit or a port, such as the output port of a subwoofer, the tubes and/or constriction will advantageously be between approximately one and two inches in front of this source. They need not be in contact with the woofer or port. When used with a high frequency (tweeter) unit, as discussed above in connection with FIGS. 2A and 2B, the tubes and constriction will advantageously be between approximately one-quarter and one-half inch in front of the diaphragm. When used with a horn unit, the tubes and constriction may be used inside or outside of the horn's mouth, with a great variety of frequency response effects thereby becoming possible.

FIG. 3A shows a non-bridge-like embodiment of this invention for the correction of speaker amplitude variations, but without realizing the secondary effect of extending the frequency response of the unit. In FIG. 3A, a low frequency "woofer" speaker 60, comparable to FIG. 1A, is shown with one or more open-ended hollow tubes 62 mounted around the perimeter of the cone's rim section 64. FIG. 3B is a schematic front view of the speaker system of FIG. 3A. In this embodiment, tubes 62 of appropriate lengths are spaced around the perimeter of rim 64 such that the axes of the tubes are at an angle to the axis of the speaker (the direction of propagation of sound produced by the speaker) and the inner open end of each tube is oriented normal to and intercepts the acoustic signals to be modified.

In FIG. 4, a speaker system 70 comprising a speaker enclosure 72 having a port 74 is corrected for speaker port coloration distortion in the form of amplitude variations in the frequency response by mounting a hollow tube 76 of appropriate length in proximity to the port such that the axis of the tube is at an angle to the axis of the port and one open end of the tube is disposed so as to intercept the acoustic signal coming from the port. This system may be advantageously used in combination with one or more of the speaker bridge or non-bridge correction devices described herein.

Figure 5A:
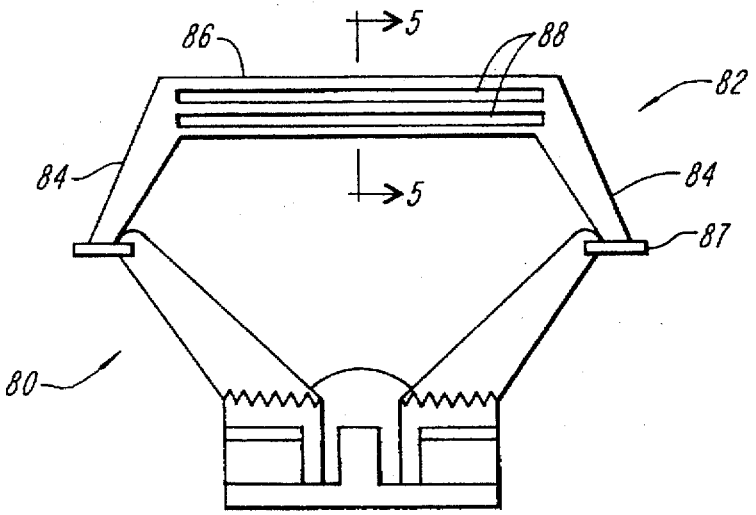
FIG. 5A is a schematic side plan view, in cross section, of a loudspeaker driver including a slotted bridge in accordance with the present invention.

In accordance with another embodiment of the present invention a slotted bridge is substituted for the pipe bridges discussed above. FIG. 5A shows a speaker unit 80 comprising a conventional speaker in combination with a slotted bridge 82 comprising one or more slots 88 designed for correcting and extending the output response of the speaker system. Slotted bridge 82 comprises two side arms 84, each connected at one end thereof to slotted section 86 and at the other end thereof to speaker rim 87, although it should be appreciated that the bridge can be supported and attached in any manner consistent with the teachings of the present invention.

Comparable to pipe bridge 20, described above in connection with FIG. 1A, slotted bridge 82 is positioned so as to span the diameter of the speaker face when centered over the speaker face, although as described in connection with the pipes, tubes or conduits, the slots 88 can be positioned in an off-centered arrangement, or in a non-bridge supported arrangement around the perimeter of the speaker system.

Figure 5B:
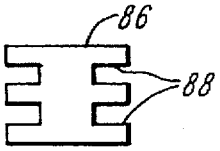
FIG. 5B is a cross sectional view of the slotted bridge taken along the line 5—5 of FIG. 5A.

Slotted section 86 of bridge 82 comprises one or more parallel slots 88 of predetermined depths running longitudinally along the top and/or bottom faces of the bridge (the slots preferably are disposed normal to the axis of propagation of the acoustic signal generated, although the slots can be oriented at a different angle) so that the open end of each slot intercepts the acoustic signal output of the loudspeaker system. FIG. 5B, a cross sectional view of slotted section 86 along the line 5—5 of FIG. 5A, illustrates the use of slots 88 along both the front and rear faces of the bridge.

As in the case of the pipes, tubes and conduits, energy at or near a particular frequency of sound can be "trapped" or diminished in amplitude by placing in the path of the sound the open edge of a slot having suitable dimensions as a function of that frequency. A slot so positioned will "trap" a frequency $F_3$ having a wavelength $\lambda_3$ approximately equal to four times the depth D of the slot (i.e., $D \approx \frac{1}{4}\lambda_3$).

When the opening of a slotted object is placed in the path of sound, and the depth of the slot is approximately one-quarter of the wavelength of the predetermined frequency component at which the frequency response is being modified, the air column created by the slot will resonate when sound at the predetermined frequency propagates across the slot. Such a resonance occurs opposite in phase to the original passing sound. The presence of such a resonance causes a drop in the amplitude of the original sound wave at the design frequency at which the resonance occurs. Tuning the depth of the slot thus allows for precise modification of the frequency of the passing sound that is modified by the slot.

The length of the slot determines the magnitude of change to the passing acoustic signal at the particular design frequency. Multiple slots having the same depth thus a high Q and greater attenuation than achieved with a single slot. Slots of different depths allow modifications at different frequencies so as to achieve a lower Q, less attenuation over a band or bands of frequency. Experiments have shown that the width of a slot has no direct effect on the amplitude correction effect. Generally, however, the width of each slot preferably should be approximately between 10% and 50% of the slot's depth. A narrower slot has been found to provide frictional losses; while a wider slot does not allow the air to operate as an air column.

In a particular application, the required slot depth may be predicted by taking the appropriate fractions of the chosen frequency's wavelength. Typically, slot depth should be slightly smaller than predicted, owing to the impedance coupling between the air column and the outside air.

As discussed above in connection with FIGS. 1A and 2A, the use of a bridge-like apparatus positioned across the face of the speaker as shown in FIG. 5A results in a secondary beneficial effect of extending the usable frequency bandwidth of the sound source. Thus, by building slots of appropriate dimensions and orientations into a constricting device, for instance in the form of the slotted bridge of FIG. 5A, it becomes possible to more carefully tailor the driver's response, having available the means to both increase and decrease the amplitude level at different frequencies. As the case of the pipes shown in FIG. 4, the slots can be mounted without a constricting device, such as the bridge, so that it will not effect the overall response. The slots for example can be provided in separate blocks independently mounted around the perimeter of the speaker system.

Figure 6:
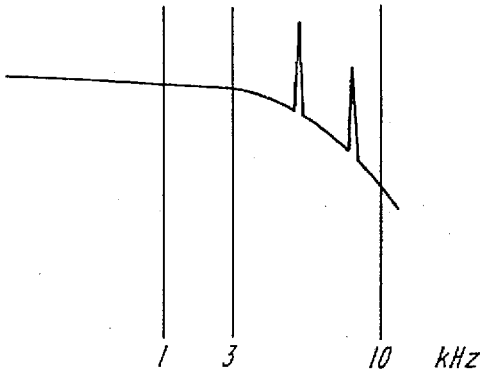
FIGS. 6–9 are graphical representations of the output spectral response of a typical loudspeaker driver illustrating how the apparatus of the present invention can correct and extend that output response.

FIGS. 6–9 illustrate graphically how the apparatus and method of the present invention can be utilized to correct and extend the output response of a sound source. FIG. 6, which shows a plot of an output response within the audible frequency range for a given speaker, illustrates a common problem with metal cone drivers. Whereas an undistorted output response would generate a desirable smooth, continuous "roll-off" above 3 kHz, the "break up" resonance frequencies of the metal cone causes undesirable, discontinuous spikes or peaks to occur between 5 kHz and 10 kHz.

Figure 7:
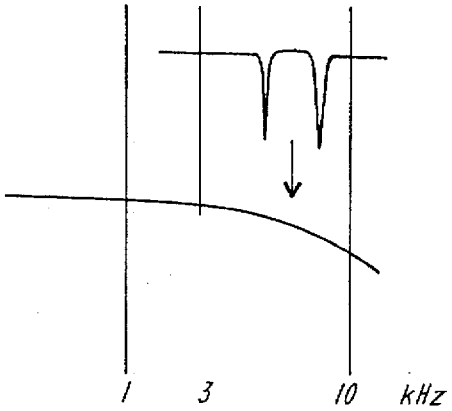

In accordance with the prior art, correction of these "peaks" would normally require costly and complex cross over networks or equalization circuits. FIG. 7 illustrates, however, how pipes or slots in accordance with the present invention can, in effect, "trap" the specific undesirable peak energy at the offending frequencies in order to smooth out the roll-off response. An array of tubes or slots will reduce the amplitude peaks in the resulting acoustic signal so that the frequency response is substantially smooth where the peak anomalies would otherwise be present.

Figure 8:
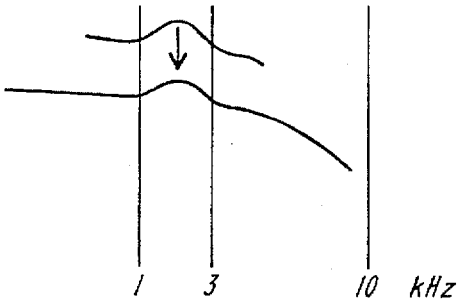
Figure 9:
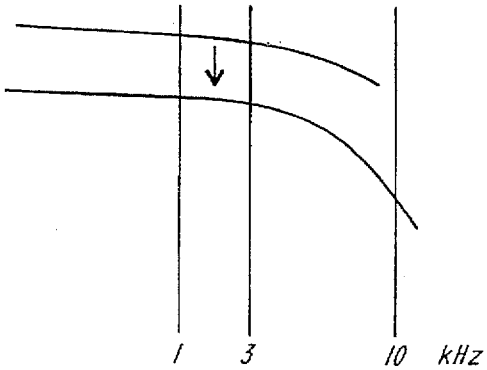

FIG. 8 illustrates how placing a constriction, such as one of the bridge-like constructions illustrated in FIGS. 1A, 2A and 5A, in the path of the sound wave can "bump up" the output response in the 1.5 kHz–3 kHz frequency range while simultaneously correcting for undesirable spikes or peaks. Normally, using a constricting bridge alone without the pipe or slot assemblies of this invention would only exacerbate the amplitude peaks. As illustrated in FIG. 9, combining the various aspects of the present invention, a speaker designer may increase voice coil inductance causing a desirable gentle roll-off (e.g. about 2 db/octave) starting at 1 kHz, with a somewhat sharper roll-off above 3 kHz. This enables a speaker designer to obtain the many benefits of a metal cone driver, such as superb precision in tracking the voice coil's movement, while retaining the desirable frequency response qualities of traditional "lossy" paper or polypropylene cones. Certain common formulations of paper and polypropylene cones have poor precision but create minimal resonance problems.

The following examples provide specific illustrations of the broad scope of application of the apparatus and method of the present invention.

EXAMPLE 1

This example relates to a metal cone (woofer) loudspeaker, whose normal operating range extends from 30 Hz to 3 kHz. The driver's response rolls off above 3 kHz, except for several narrow 12 dB peaks between 5 kHz and 10 kHz. In accordance with the prior art approach, a low pass filter of a cross over network, having a very steep roll off at 3 kHz, must be used to eliminate the peaks by filtering out all of the signal energy within a frequency band containing the peaks. In accordance with the present invention, a set of tubes or slots will reduce the acoustic output at the resonant frequencies where the peaks occur, resulting in a more normal roll off and the use of the remaining signal energy within the otherwise lost frequency band. The tubes or slots are contained in a constricting bridge, which raises the output between 1.5 kHz and 3 kHz. Since the driver now has a frequency response rise between 1.5 and 3 kHz, the designer may increase the voice coil inductance, inducing a gentle roll-off. The result is a woofer with a response of 30 Hz to 3 kHz, with the frequency response attributes of a traditional lossy paper or polypropylene cone, and the need for a much simpler crossover system.

EXAMPLE 2

This example relates to an aluminum or titanium 1-inch dome tweeter unit that extends evenly from 1 kHz to 20 kHz. At about 24 kHz, there will be a large (6–12 dB) amplitude peak stemming from the material break-up. The response will roll off by 25 kHz. A set of tubes or slots in the form of a bridge will eliminate the peak, while the constriction will extend the response. The result is a tweeter with a useful response from 1 kHz to 40 kHz on axis.

EXAMPLE 3

This example relates to correction of crossover networks. If economies of manufacturing or design dictate that a ferrous cored low resistance inductor must be used in a crossover network, there may be a problem with coil saturation, particularly if the inductor uses an iron core. More specifically, when the current level through the inductor reaches a certain level, which can be predicted based on its physical attributes, its inductance value will change drastically, thus varying the response of the loudspeaker system. Use of a set of tubes or slots in front of a speaker driver in some cases will be a cost-effective way of masking the problems caused by the inductor, or avoiding the need of the inductor altogether.

EXAMPLE 4

This example relates to correction of speaker port coloration. The port and cabinet each typically have resonances based on their dimensions, and they can interact and reinforce each other. These resonances typically occur in the range of 100 Hz–600 Hz on a bass system. A set of tubes or slots placed at the mouth of a vented speaker's port can absorb resonant peaks resulting from port and internal cabinet resonances. The mouths of the tubes or slots will generally be between one and two inches from the port's mouth.

EXAMPLE 5

This example relates to correction of acoustic feedback. The frequency at which frequency oscillation occurs can be determined by detecting the peaks in the frequency response of the microphone and loudspeaker system producing the feedback. Depending on the frequency of the feedback oscillation, one tube or a set of tubes may be placed in front of the appropriate speaker driver to reduce or eliminate acoustic feedback. As each microphone/speaker combination will produce its own unique feedback frequencies, and because public address systems must often be transportable, a tube system for such application preferably is adjustable on location. In accordance with this invention, such adjustment would be facilitated by the use of tubes with movable plungers which could be tuned by the sound technician on site to tune out each speaker's characteristic feedback. It may also be possible to place tubes around a microphone to prevent feedback.

It should be appreciated that although the various embodiments have been primarily described in connection with suspension speakers in the form of tweeters, woofers and subwoofers, the restrictive bridge and the resonant tubes and/or slots of the present invention also may be used with equal effectiveness on any speaker driver formats, including midrange speakers, as well as electrostatic speakers, and ribbon transducers, etc. In addition, resonant tubes and/or slots may be used to control other spurious loudspeaker noises, such as port coloration or cabinet panel resonances.

Thus, the apparatus and method of the present invention can reduce or eliminate the need for crossover networks and equalizers in acoustic systems. The loudspeaker designer has an additional tool for tailoring a speaker response. A sound reinforcement technician may be able to eliminate the equalizers that are normally used to tune out feedback.

Since other changes may be made in the above-described apparatus and process without departing from the scope of the invention herein involved, it is intended that all matter contained in the above description shall be interpreted in an illustrative and not in a limiting sense.

Having described the invention, what is claimed is:

1. Apparatus for modifying the output response of an acoustic device by correcting for amplitude variations occurring in at least one narrow frequency band of the frequency response of the device, said apparatus comprising:

means for defining at least one elongated slot having an open edge, each slot corresponding to and being dimensioned so as to correct for said distortion, and each slot having a depth equal to approximately one-quarter of the wavelength of a frequency within said frequency band; and means for supporting said at least one elongated slot such that the axis of each slot is disposed at an angle to the direction of propagation of acoustic signals so that the open edge of said slot intercepts the acoustic signals as they are generated by said device, said means for supporting including a bridge having side arms connected to a center slotted section at opposite ends thereof, wherein said center slotted section is formed with at least one slot so as to form said means for defining said at least one slot, and wherein said side arms are substantially equal in length and each is disposed at an oblique angle with respect to said center slotted section.

2. A system for generating an acoustic signal, said system comprising:

an acoustic signal generating device (a) having a frequency response defining a frequency pass band within which acoustic signals can be generated, and (b) providing along an axis of propagation an acoustic signal output as a function of said frequency response, wherein said pass band has an upper frequency portion; and an apparatus for modifying the acoustic signal output of said acoustic signal generating device by correcting for distortion in the form of amplitude variations occurring in the upper frequency portion of said frequency pass band of the frequency response of said acoustic signal generating device and for extending the upper frequency portion of the frequency pass band of the frequency response of said acoustic signal generating device, said apparatus comprising means, positioned in the path of said acoustic signal, and shaped, dimensioned and disposed so as to (1) modify said acoustic signal in order to correct for said distortion by substantially reducing or eliminating said amplitude variations occurring in the upper frequency portion of said frequency pass band, and (2) provide an enhanced frequency response of the combination of said acoustic signal generating device and said apparatus defining a resulting frequency band wider than said frequency pass band of said acoustic signal generating device, said means positioned in said path of said acoustic signal comprising:

a bridge element disposed in said path of said acoustic signal output transversely to said axis of propagation of said acoustic signal output so that said acoustic signal output is transmitted on each side of the bridge element so as to provide said enhanced frequency response, and means, disposed on the bridge element and defining openings disposed transverse to said axis of propagation, for modifying said acoustic signal in order to correct for said distortion by substantially reducing or elimination said amplitude variations occurring in the upper frequency portion of said frequency pass band.

3. A system according to claim 2, wherein said means disposed on the bridge element for modifying said acoustic signal includes at least one pipe having at least one open end for intercepting at least a portion of the acoustic signal output.

4. A system according to claim 3, wherein said at least one pipe has a depth from the open end substantially equal to a fraction of a wavelength within said upper frequency portion of said frequency pass band of the frequency response at which said amplitude variations occur.

5. A system according to claim 4, wherein the depth of said at least one pipe is substantially equal to one-half the wavelength within said upper frequency one portion of said frequency pass band.

6. A system according to claim 2, wherein said means disposed on the bridge element for modifying said acoustic signal includes a plurality of pipes, each of said pipes having (i) at least one open end for intercepting at least a portion of the acoustic signal output, and (ii) a depth from the open end substantially equal to a fraction of a wavelength within said upper frequency portion of said frequency pass band of the frequency response at which said amplitude variations occur.

7. A system according to claim 6, wherein said plurality of pipes are spaced along said bridge element transversely to said axis of propagation.

8. A system according to claim 2, wherein said means disposed on the bridge element for modifying said acoustic signal includes at least one pipe having opposite open ends for intercepting at least a portion of the acoustic signal output on the corresponding opposite sides of said bridge element.

9. A system according to claim 8, wherein said at least one pipe has a depth from each open end substantially equal to a fraction of a wavelength within said upper frequency portion of said frequency pass band of the device frequency response at which said amplitude variations occur.

10. A system according to claim 9, wherein said at least one pipe is open between its open ends and the depth of said at least one pipe is substantially equal to one-half the wavelength within said upper frequency one portion of said frequency pass band.

11. A system according to claim 2, wherein said means disposed on the bridge element for modifying said acoustic signal includes a plurality of pipes having (i) opposite open ends for intercepting at least a portion of the acoustic signal output on the corresponding opposite sides of said bridge element, and (ii) a depth from each open end is substantially equal to a fraction of a wavelength within said upper frequency portion of said frequency pass band of the device frequency response at which said amplitude variations occur.

12. A system according to claim 11, wherein said plurality of pipes are spaced along said bridge element transversely to said axis of propagation.

13. A system according to claim 2, wherein said means disposed on the bridge element for modifying said acoustic signal includes at least one open slot positioned for intercepting at least a portion of acoustic signal output.

14. A system according to claim 13, wherein said at least one open slot has a depth equal to a fraction of a wavelength within said upper frequency portion of said frequency pass band of the device frequency response at which said amplitude variations occur.

15. A system according to claim 13, wherein the depth of said at least one open slot is substantially equal to one-quarter the wavelength within said upper frequency portion of said frequency pass band.

16. A system according to claim 2, wherein said means disposed on the bridge element for modifying said acoustic signal includes a plurality of open slots, each positioned for intercepting at least a portion of said acoustic signal output.

17. A system according to claim 16, wherein said plurality of slots are spaced along said bridge element along said axis of propagation.

18. A loudspeaker system comprising:

(a) a loudspeaker driver having a moving diaphragm defining a speaker face, said loudspeaker driver having an output frequency response having distortions in the form of amplitude variations occurring in at least one narrow frequency band of the frequency response of the driver;

(b) frequency response modification means comprising a plurality of hollow pipes, each pipe corresponding to and being so dimensioned, shaped, and disposed as to correct for said distortions, and means for supporting said pipes such that at least one open end of each pipe intercepts an output signal from the loudspeaker driver, and is disposed so as to cause at least a partial cancellation of said amplitude variations;

(c) a ported speaker enclosure, cooperative with said loudspeaker driver, and subject to speaker port coloration distortion in the form of amplitude variations within a narrow frequency band of the frequency response of said enclosure, a hollow tube so dimensioned and disposed as to correct for said coloration distortion; and (d) means for mounting said tube outside said enclosure such that the axis of the tube is substantially perpendicular to the axis of the port and one open end of said tube intercepts sound propagated from said port.

19. The loudspeaker according to claim 18, wherein said loudspeaker includes a metal cone.

* * * * *

UNITED STATES PATENT AND TRADEMARK OFFICE

CERTIFICATE OF CORRECTION

PATENT NO.: 5,689,573

DATED: November 18, 1997

INVENTOR(S): P. K. G. Jones

It is certified that errors in the above-identified patent and that said Letters Patent is hereby corrected as shown below:

Claim 2, column 13, line 47, delete "elimination", and substitute therefor -- eliminating --;

Claim 5, column 13, line 62, after "frequency" delete "one"; and

Claim 10, column 14, line 23, after "frequency" delete "one".

Signed and Sealed this

Third Day of February, 1998

*Attest:*

*Attesting Officer*

BRUCE LEHMAN

*Commissioner of Patents and Trademarks*